US010969140B2

(12) United States Patent
Hou et al.

(10) Patent No.: US 10,969,140 B2
(45) Date of Patent: Apr. 6, 2021

(54) WATER BOILER

(71) Applicant: Xiamen Aquasu Electric Shower Co., Ltd., Xiamen (CN)

(72) Inventors: Quanduo Hou, Xiamen (CN); Yan Zeng, Xiamen (CN); Yihui Hong, Xiamen (CN); Yan Wang, Xiamen (CN); Shaohong Gao, Xiamen (CN)

(73) Assignee: XIAMEN AQUASU ELECTRIC SHOWER CO., LTD., Xiamen (CN)

( * ) Notice: Subject to any disclaimer, the term of this patent is extended or adjusted under 35 U.S.C. 154(b) by 284 days.

(21) Appl. No.: 16/205,196

(22) Filed: Nov. 29, 2018

(65) Prior Publication Data

US 2019/0178529 A1 Jun. 13, 2019

(51) Int. Cl.

| | |
|---|---|
| ***F24H 9/18*** | (2006.01) |
| ***F24H 1/18*** | (2006.01) |
| ***F24H 9/20*** | (2006.01) |
| ***F24H 1/20*** | (2006.01) |
| ***F24H 9/02*** | (2006.01) |
| *F24H 9/00* | (2006.01) |

(52) U.S. Cl.

CPC ..... *F24H 9/1818* (2013.01); *F24H 1/185* (2013.01); *F24H 1/188* (2013.01); *F24H 1/201* (2013.01); *F24H 9/02* (2013.01); *F24H 9/2021* (2013.01); *F24D 2220/042* (2013.01); *F24H 9/0015* (2013.01); *F24H 2250/02* (2013.01)

(58) Field of Classification Search

None

See application file for complete search history.

(56) References Cited

U.S. PATENT DOCUMENTS

| | | | | | |
|---|---|---|---|---|---|
| 1,596,987 | A * | 8/1926 | Morley et al. | F24H 1/207 | 122/13.01 |
| 1,597,008 | A * | 8/1926 | Birtch | F24H 1/207 | 122/19.1 |
| 1,602,352 | A * | 10/1926 | Foley | G05D 23/125 | 236/32 |
| 1,984,791 | A * | 12/1934 | Finken | F24D 3/087 | 165/84 |
| 2,834,865 | A * | 5/1958 | Coates | F24H 1/202 | 392/450 |
| 2,870,318 | A * | 1/1959 | Karlen | F24H 1/202 | 392/451 |
| 2,903,551 | A * | 9/1959 | Fischer | F24H 1/202 | 392/451 |
| 3,581,057 | A * | 5/1971 | Meyers | A47J 31/54 | 392/451 |

(Continued)

*Primary Examiner* — Thor S Campbell

(57) ABSTRACT

A water boiler comprises an inner tank, an electric heating pipe, and a controller. A lower cover is attached to a mouth of the inner tank. The lower cover comprises an inlet pipe and an outlet pipe, wherein an outlet port at a lower part of the inlet pipe is in communication with lower part within the inner tank. An inlet port of a lower part of the outlet pipe is in communication with an upper part of the inner tank. The lower cover is arranged beneath the upper cover. An upper part of the inlet pipe passes through the upper cover. A cavity is formed between the lower cover and the upper cover. The cavity is partitioned into an upper chamber and a lower chamber by a diaphragm. The lower chamber is in communication with an outer space.

10 Claims, 10 Drawing Sheets

(56) References Cited

U.S. PATENT DOCUMENTS 3,935,077 A * 1/1976 Dennison ..... B01D 3/00 202/83
4,135,984 A * 1/1979 Kirschmann ..... B01D 3/02 202/196
4,141,343 A * 2/1979 Awano ..... F24H 1/44 122/20 A
4,263,498 A * 4/1981 Meyers ..... F24H 1/188 137/205.5
4,339,307 A * 7/1982 Ellis, Jr. ..... C02F 1/18 202/176
4,590,992 A * 5/1986 Tamblyn ..... F24D 11/002 165/104.19
4,612,090 A * 9/1986 Ellis, Jr. ..... B01D 3/02 202/176
4,906,817 A * 3/1990 Kurz ..... F24H 1/188 392/442
4,957,200 A * 9/1990 Turner ..... B01D 1/0017 202/181
4,990,746 A * 2/1991 Hammond ..... F24D 3/08 222/108
5,178,734 A * 1/1993 Palmer ..... B01D 3/02 159/44
5,343,552 A * 8/1994 Peteri ..... A47J 31/54 392/451
5,388,179 A * 2/1995 Boyd, Jr. ..... F24H 9/2014 200/84 B
5,662,779 A * 9/1997 Greene ..... C02F 1/04 202/181
5,775,267 A * 7/1998 Hou ..... F24H 1/124 122/18.4
5,898,818 A * 4/1999 Chen ..... F24H 1/202 392/449
6,094,524 A * 7/2000 Riley ..... F24H 1/188 392/441
6,266,485 B1 * 7/2001 DeSantis ..... F24H 1/181 222/146.5
6,424,801 B1 * 7/2002 Rabadi ..... F24H 1/102 392/450
6,847,782 B1 * 1/2005 Kovacs ..... F24H 1/202 392/441
9,702,544 B2 * 7/2017 Amoretti ..... F22B 1/284
10,378,790 B2 * 8/2019 Hou ..... F24H 1/202
10,458,103 B2 * 10/2019 Tang ..... F24D 17/0089
2007/0044736 A1 * 3/2007 DeSantis ..... F24H 1/188 122/19.1
2010/0065414 A1 * 3/2010 Rautenbach ..... B01D 1/0017 202/167
2010/0290763 A1 * 11/2010 Boulay ..... F28D 20/0039 392/451
2011/0017652 A1 * 1/2011 Bartolini ..... D06F 75/14 210/282
2012/0051725 A1 * 3/2012 Chen ..... F24D 17/0089 392/443
2019/0111894 A1 * 4/2019 Sato ..... F24H 1/201
2019/0285314 A1 * 9/2019 Shaffer ..... G05D 23/1346
2020/0124321 A1 * 4/2020 Shaffer ..... F24H 9/2021

* cited by examiner

WATER BOILER

CROSS-REFERENCE TO RELATED APPLICATIONS

The present application claims the benefit of Chinese Patent Application No. 201711291180.3, filed on Dec. 8, 2017. The above is hereby incorporated by reference.

TECHNICAL FIELD

The subject matter herein relates to a water boiler.

BACKGROUND

Steam is generated and thermal expansion occurs when water is boiled. To decompress the inner tank of a water boiler, water boilers currently available on the market typically have an inner tank with an open design. However, the open inner tank causes the following problems: steam generated within the inner tank may find its way out and cause scalding; and the leakage of steam will undoubtedly waste energy. A closed inner tank addresses the problems caused by the open inner tank, but requires more pressure resistance, which increases the manufacture cost due to the material and thickness of the inner tank.

SUMMARY

The present disclosure addresses the technical problem by providing a water boiler, which can effectively prevent the leakage of steam and the overflow of high-temperature water. It improves the safety of use, reduces energy loss, and has lower production cost.

In an embodiment of the present disclosure a water boiler comprises an inner tank, which is barrel-shaped, an electric heating pipe, and a controller. A lower cover is attached to a mouth of the inner tank. The lower cover comprises an inlet pipe and an outlet pipe, wherein an outlet port at a lower part of the inlet pipe is in communication with a lower part within the inner tank. An inlet port of a lower part of the outlet pipe is in communication with an upper part of the inner tank. The lower cover is arranged beneath the upper cover. An upper part of the inlet pipe passes through the upper cover. A cavity is formed between the lower cover and the upper cover. The cavity is partitioned into an upper chamber and a lower chamber by a diaphragm. The lower chamber is in communication with the outer space. A separator is formed within an inner hole of the upper part of the inlet pipe. A through hole is arranged on the center of the separator. The inlet pipe under the through hole comprises a radial communication hole. The radial communication hole is in communication between the upper chamber and the inner hole of the inlet pipe. The electric heating pipe is located at an outer bottom of the inner tank or is located within the inner tank. The controller controls the work of the electric heating pipe.

In some embodiments, an upper flange which extends outwardly is arranged on top of the inner tank. An outer side of the lower cover is provided with a middle flange which extends outwardly. A middle part of the upper cover is provided with a lower flange which extends outwardly. The upper flange, the middle flange, and the lower flange are fastened via bolt connection for easy installation.

In some embodiments, a diaphragm holder is arranged between the lower cover and the upper cover. The cavity is located between the upper cover and the diaphragm holder.

The diaphragm holder comprises a vent at the bottom of the diaphragm holder. The vent is in communication with the outer space. A periphery of the diaphragm is clamped between an upper side of the diaphragm holder and the upper cover. The diaphragm and the upper cover together form the upper chamber. The diaphragm and the diaphragm holder together form the lower chamber. The lower chamber is in communication with the outer space through the vent. Such configuration creates a large space for the upper chamber and the lower chamber, and also facilitates the installation of the diaphragm.

In some embodiments, a spacer is arranged between the diaphragm holder and the lower cover. An air passage in communication with the outer space is formed between the spacer and the diaphragm holder. The air passage is in communication with the vent. The air passage formed by the assembly of the spacer and the diaphragm holder allows the diaphragm to be deformable.

In some embodiments, a temperature sensing pipe is arranged within the inner tank. An upper temperature sensor is arranged in an upper part of the temperature sensing pipe. A lower temperature sensor is arranged in an lower part of the temperature sensing pipe. When the lower temperature sensor detects that the water temperature is lower than a first predetermined value, the controller initiates the electric heating pipe to start heating. When the upper temperature sensor detects that the water temperature is higher than a second predetermined value, the controller halts the work of the electric heating pipe. The water temperature can be precisely controlled by the cooperation of the upper temperature sensor and the lower temperature sensor as well as the controller.

In some embodiments, a metal water level detector is arranged on the lower cover. When the water level in the inner tank is lower than the metal detector, the controller cuts off the power supply to the electric heating pipe. It prevents dry burn improves the safety of use.

In some embodiments, a baffle is arranged on an inlet pipe bottom end of the inlet pipe. The outlet port at the inlet pipe lower part is beneath the baffle. Such design stops unheated or inadequately heated water from passing through the outlet pipe when the cool water reaches the inner tank upper part due to the high water pressure within the inner tank.

In some embodiments, the inlet pipe comprises an upper pipe, a middle pipe, and a lower pipe. The upper pipe is integrally formed with the upper cover, and the middle pipe is integrally formed with the lower cover. The separator is arranged within the inner hole of the upper pipe. The through hole is arranged on a middle part of the separator. An upper part of the middle pipe is fitted into a lower part of the upper pipe. The radial communication hole is arranged within the upper pipe. The radial communication hole is located between the through hole and a top end of the middle pipe. The upper chamber and the inner hole of the upper pipe is in communication via a radial communication hole. A top end of the lower pipe is fitted into the lower part of the middle pipe. The inlet pipe constructed as above can facilitate the assembly of each component. Different materials may be adopted to manufacture the upper pipe, the middle pipe, and the lower pipe for different work environment. Moreover, change or replacement of the lower pipe may be convenient.

In some embodiments, a clamping protrusion is arranged on an outer surface of the upper part of the lower pipe. The clamping protrusion has a polygonal cross section. A matching inner wall is arranged within the middle pipe. The matching inner wall is designed to have a polygonal cross section for matching with the clamping protrusion. The fitting of the clamping protrusion and the matching inner wall secures the middle pipe and the lower pipe in a circumferential direction. A clamping groove is arranged on both the lower part of the middle pipe and the upper part of the lower pipe. A U-shaped clip is arranged on the clamping groove for securing the middle pipe and the lower pipe in a radial direction. Such design would facilitate the assembly of the lower pipe.

In some embodiments, a bend section is arranged on a middle part of the lower pipe. The outlet port on a bottom end of the lower pipe faces a center of a bottom of the inner tank. The baffle is attached to the bottom end of the lower pipe. The outlet port is located beneath the baffle so that the cool water cannot reach the upper part of the inner tank.

In the present disclosure, the inner tank is configured to be a closed structure when the outlet pipe is closed, so as to prevent the steam and high-temperature water drop from running off when boiled. Because of the existence of a cavity between the upper cover and the lower cover, and a flexible diaphragm separating the cavity into an upper chamber and a lower chamber, the steam and expanded water generated during the water boiling can be absorbed by the upper chamber, which reduces the pressure in the inner tank. Since the pressure within the inner tank can be reduced, the inner tank can be made of a material other than those with special strength requirement, thereby reducing the manufacture cost.

Another advantage of the present disclosure is to reduce energy waste because no steam or high-temperature water drop would run off the inner tank.

DETAILED DESCRIPTION OF THE INVENTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical," "horizontal," "left," "right," "upper," "lower," and the like, are for illustrative purposes only and are not meant to be the only orientation.

Figure 1:
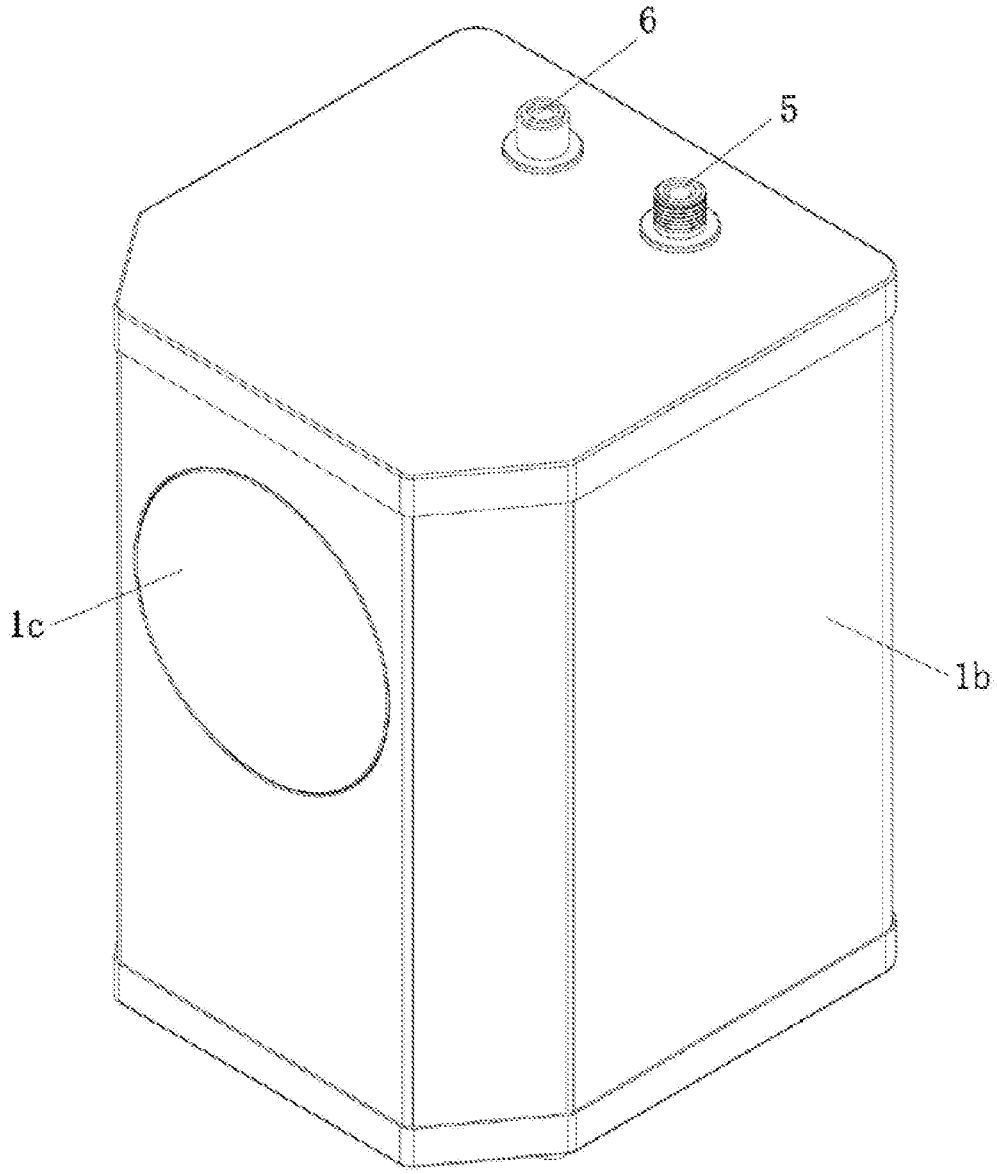
FIG. 1 is a schematic diagram of a water boiler according to one embodiment of the present disclosure.
Figure 2:
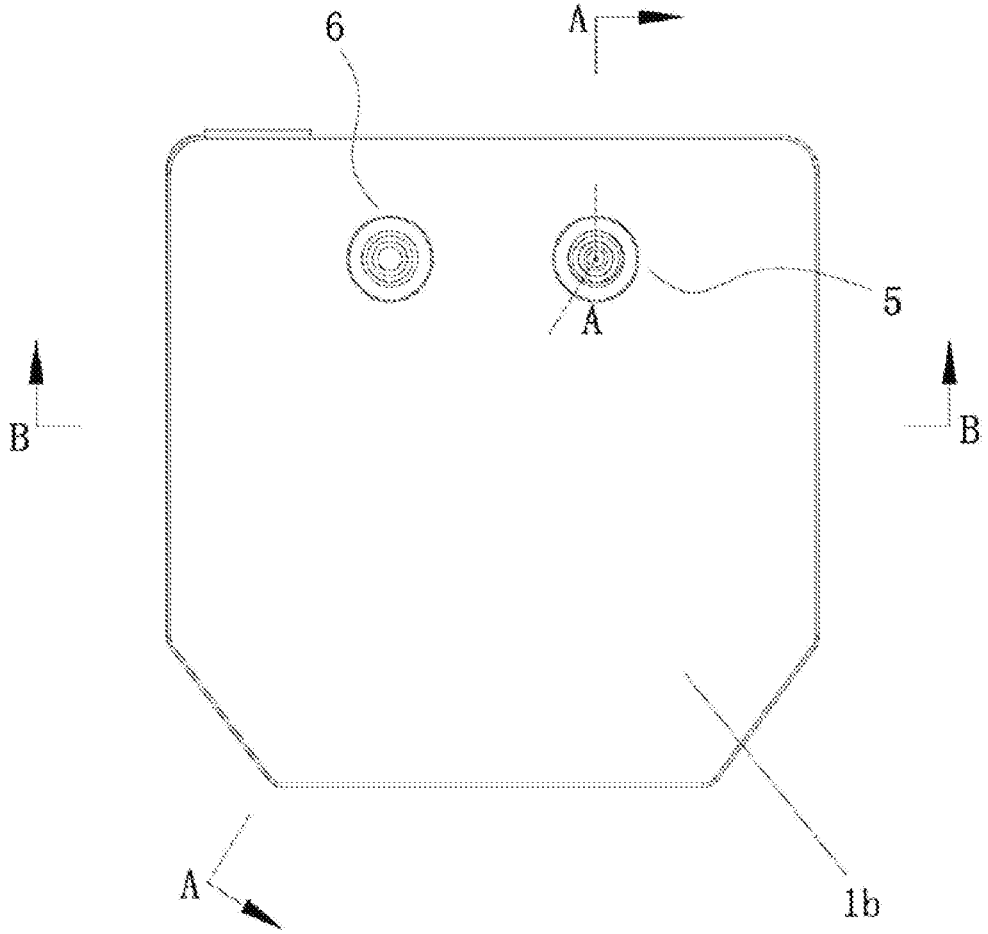
FIG. 2 is a bottom view of the water boiler according to one embodiment of the present disclosure.
Figure 3:
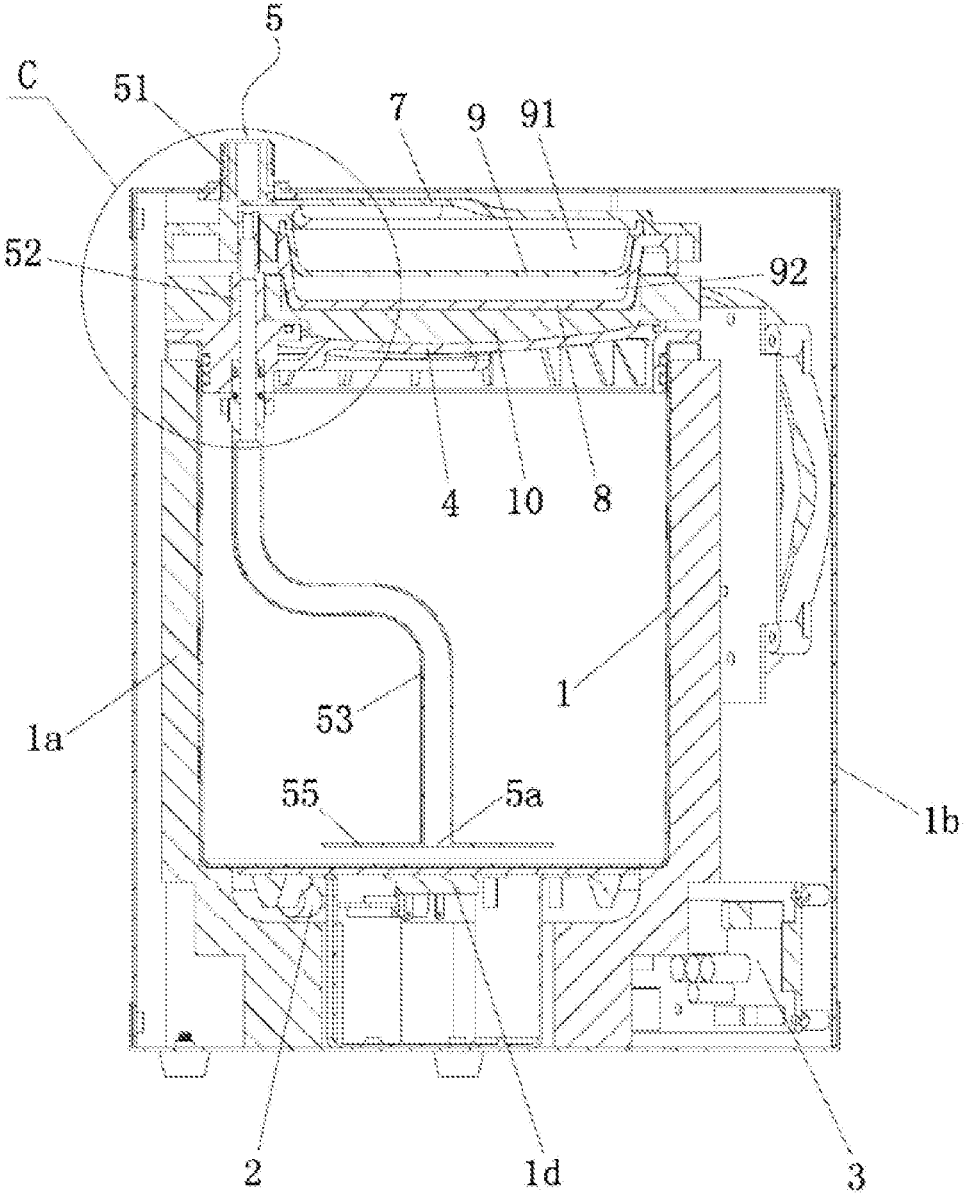
FIG. 3 is a cross sectional view of the water boiler along lines in FIG. 2.
Figure 4:
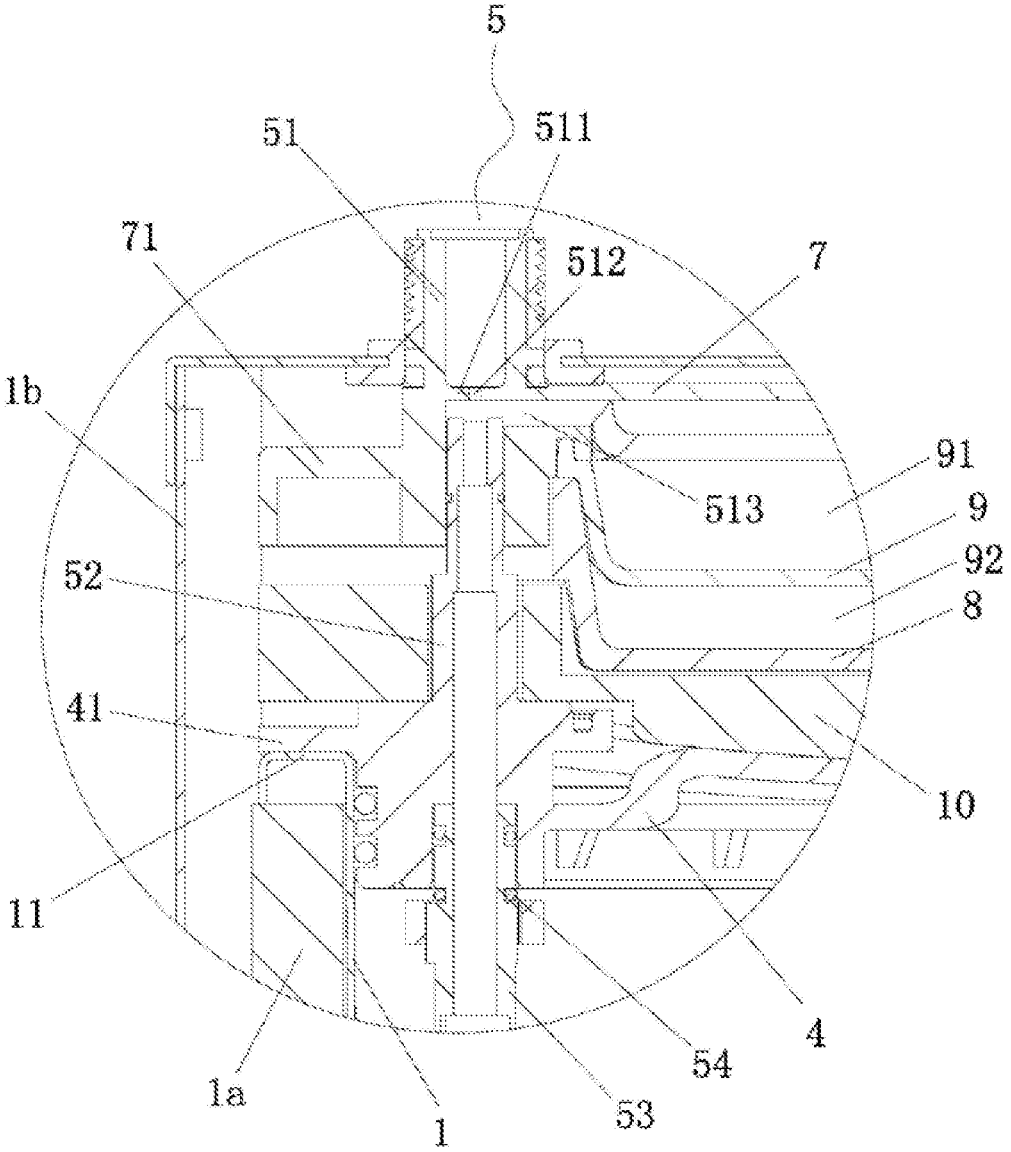
FIG. 4 is an enlarged view of circle IV in FIG. 3.
Figure 5:
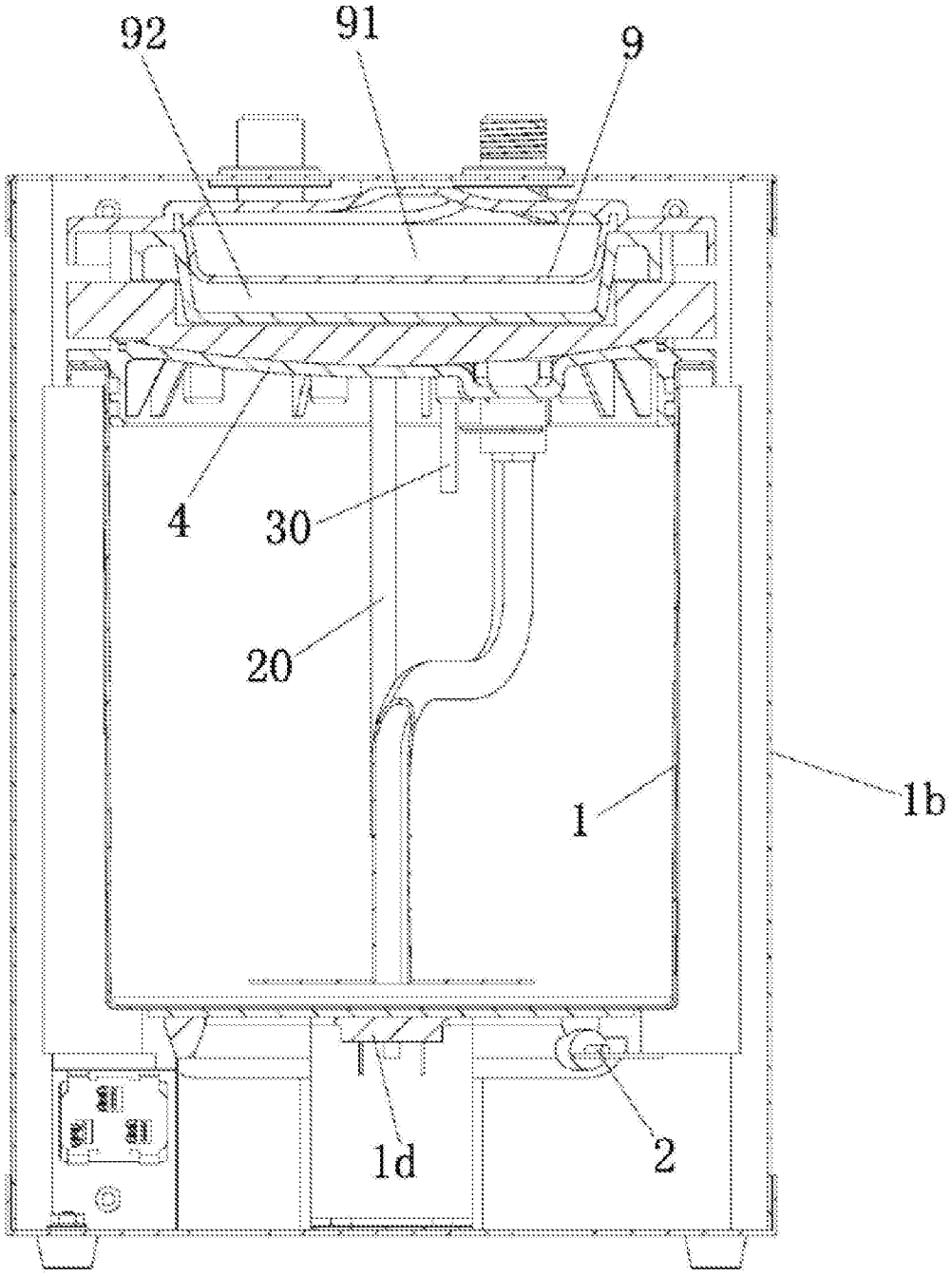
FIG. 5 is a cross sectional view of the water boiler along lines V-V in FIG. 2.
Figure 6:
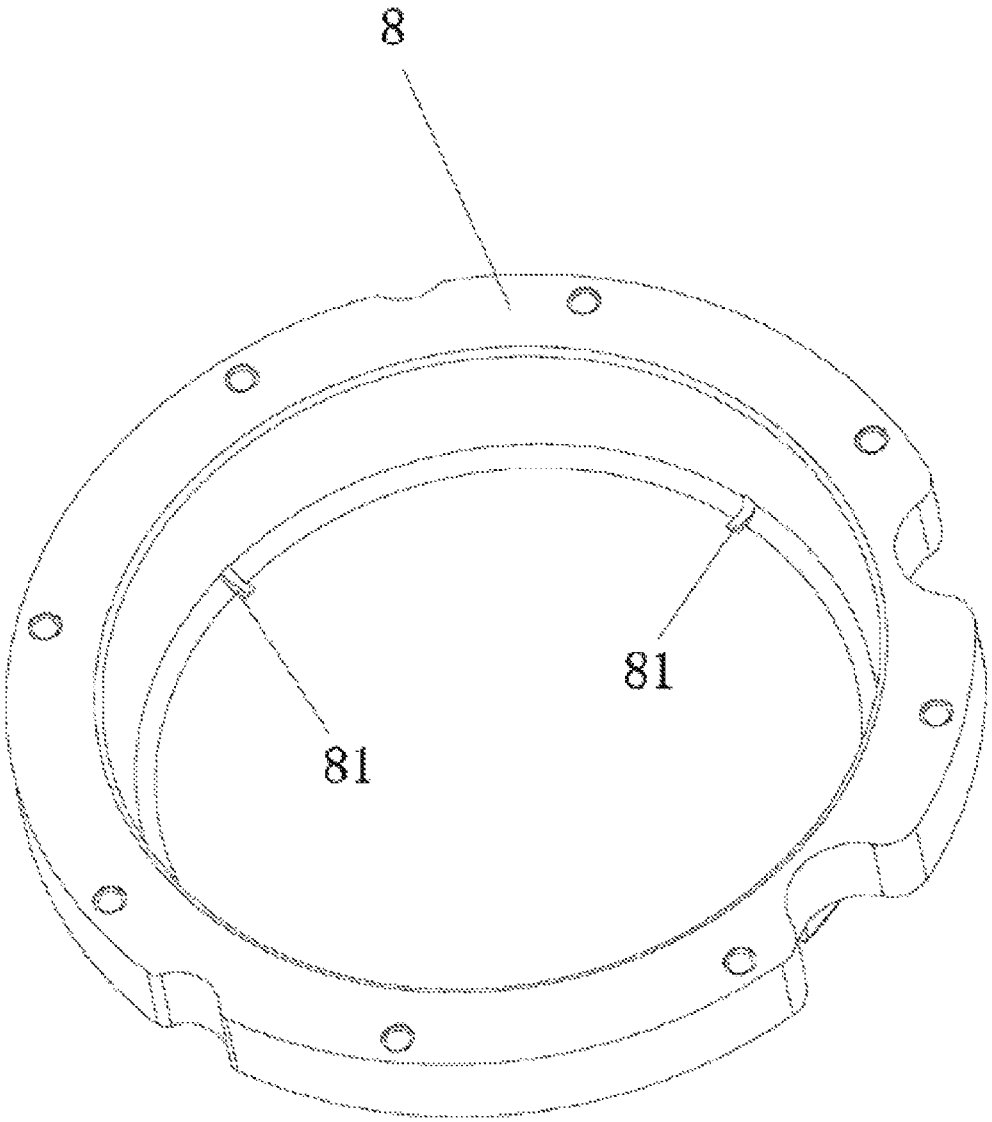
FIG. 6 is a perspective view of a diaphragm holder, viewed from top, according to one embodiment of the present disclosure.
Figure 7:
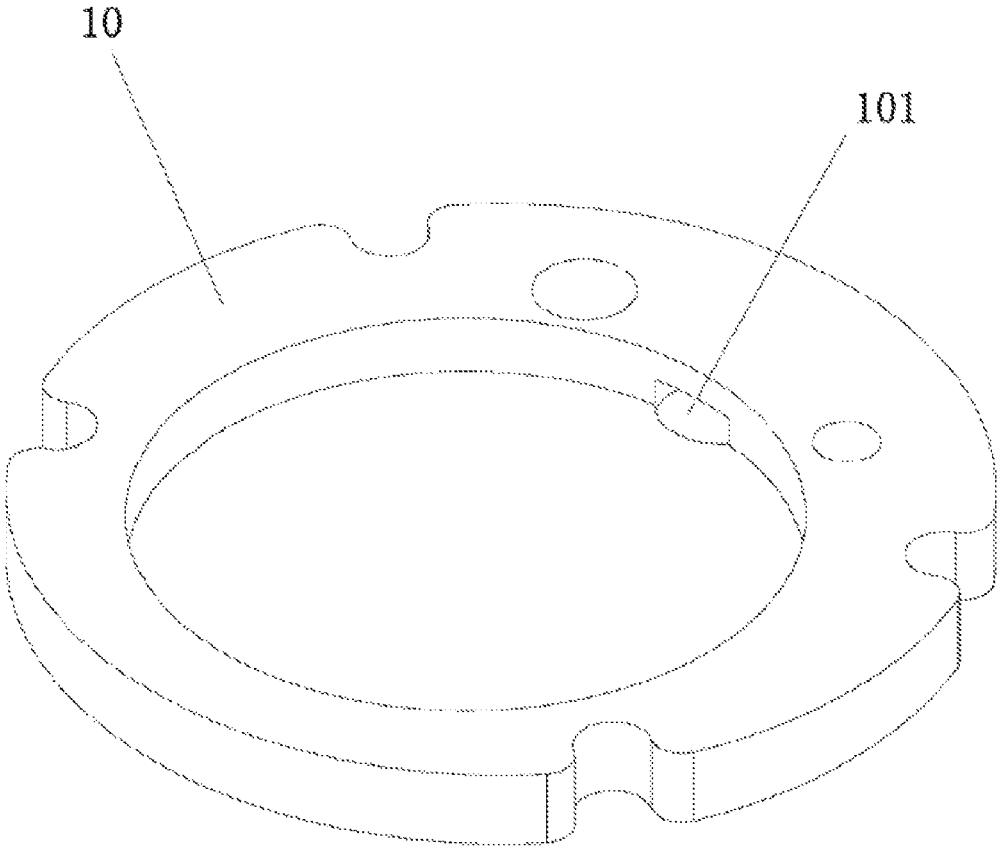
FIG. 7 is a perspective view of a spacer, viewed from top, according to one embodiment of the present disclosure.
Figure 8:
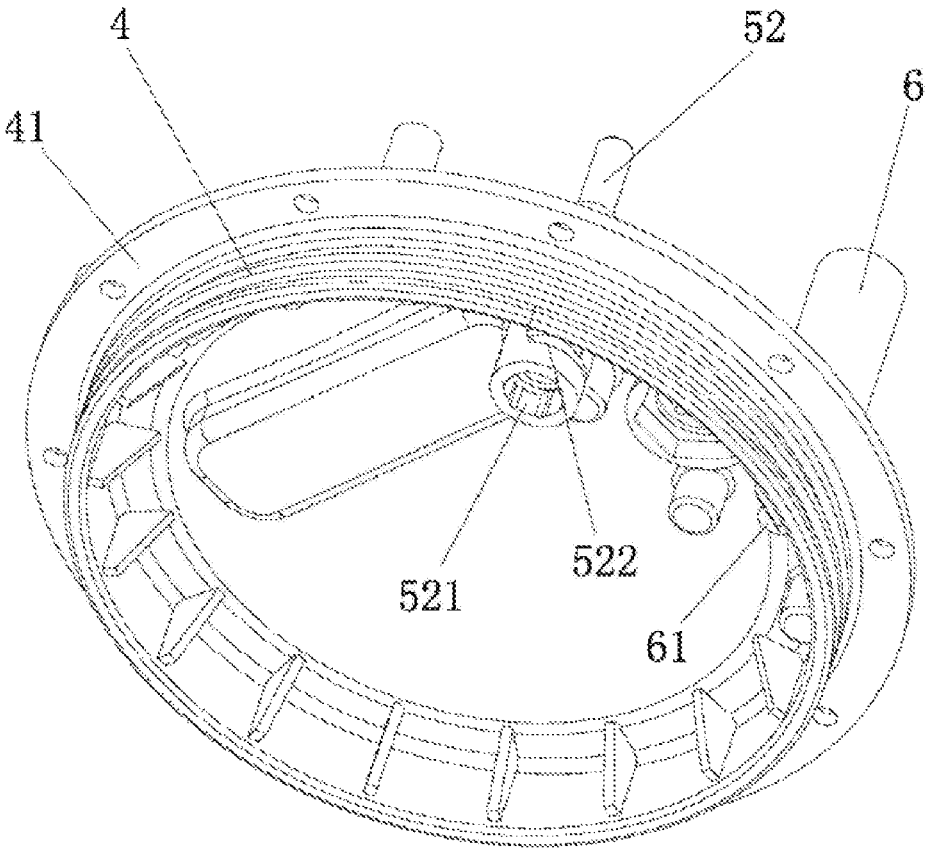
FIG. 8 is a perspective view of a lower cover, viewed from bottom, according to one embodiment of the present disclosure.
Figure 9:
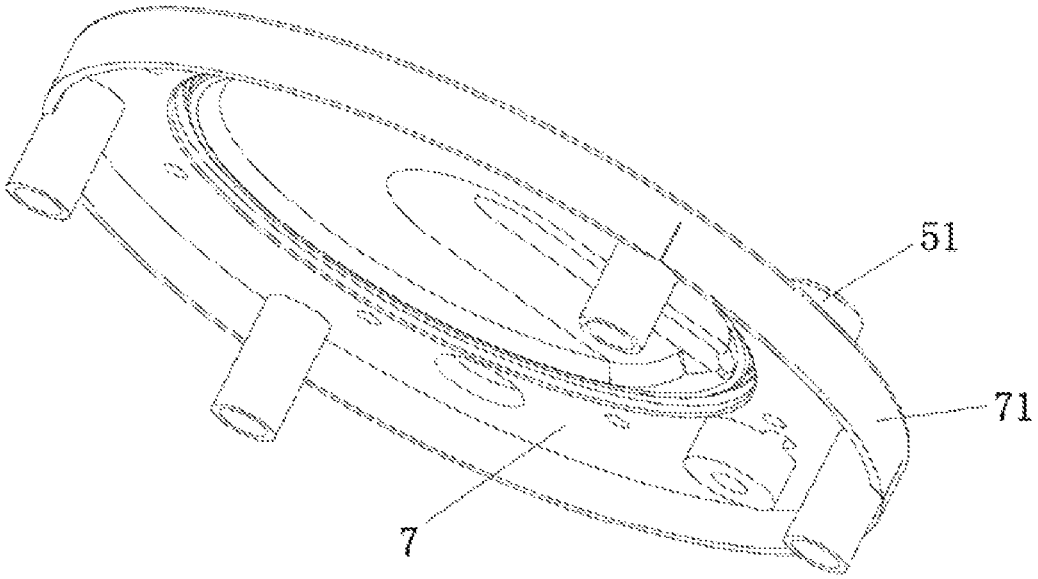
FIG. 9 is a perspective view of an upper cover, viewed from bottom, according to one embodiment of the present disclosure.
Figure 10:
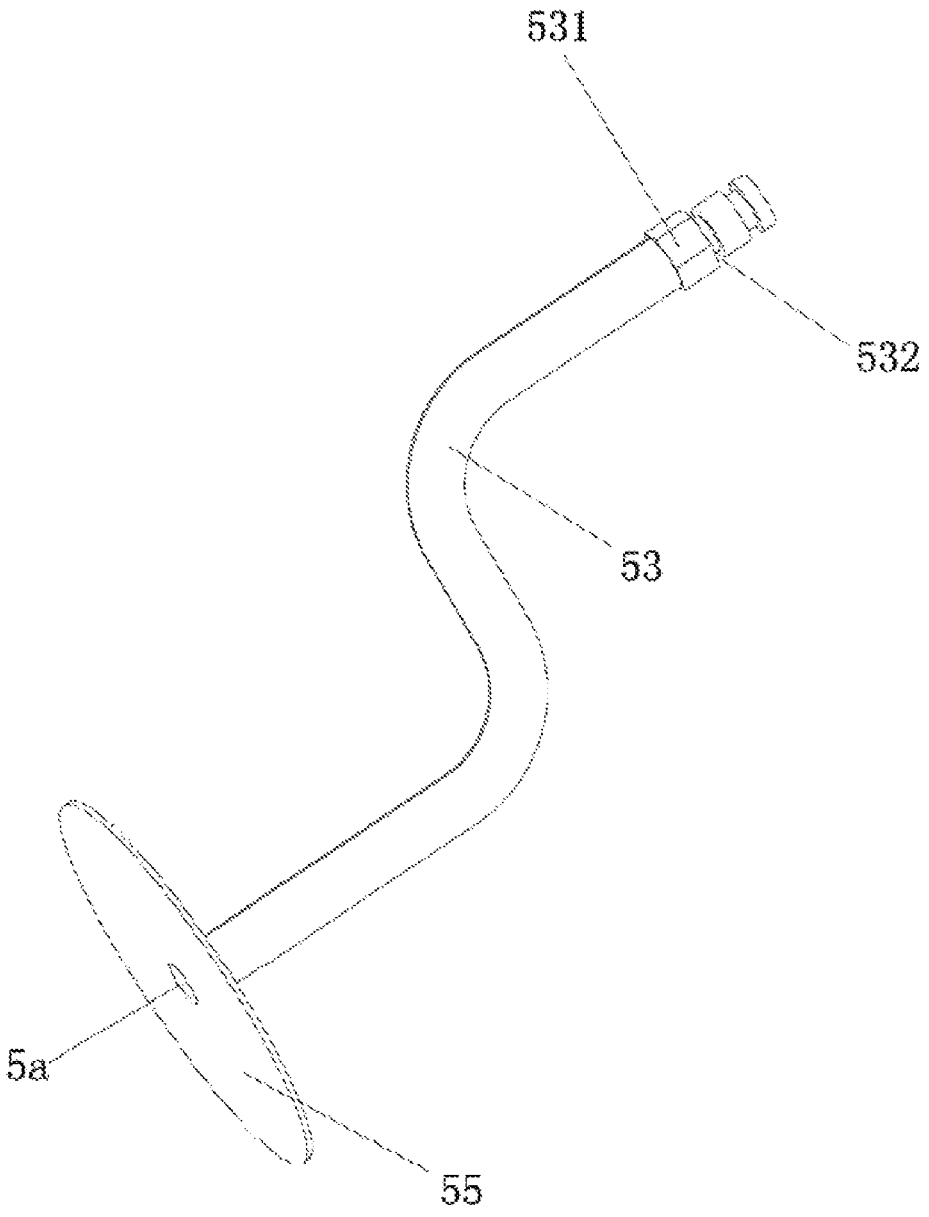
FIG. 10 is a schematic diagram of the lower cover and the baffle according to one embodiment of the present disclosure.

As shown in FIGS. 1-10, a water boiler is provided. The water boiler comprises an inner tank 1, which can be barrel-shaped, an electric heating pipe 2, and a controller 3. A lower cover 4 is attached to a mouth of the inner tank 1. The lower cover 4 comprises an inlet pipe 5 and an outlet pipe 6, wherein an outlet port 5*a* at a lower part of the inlet pipe 5 is in communication with an lower part of the inner tank 1. An inlet port 61 of a lower part of the outlet pipe is in communication with an upper part of the inner tank. The outlet pipe 6 is integrally formed with the lower cover 4. The lower cover 4 is arranged beneath the upper cover 7. A diaphragm holder 8 is arranged between the lower cover 4 and the upper cover 7. A cavity is formed between the lower cover 4 and the upper cover 7. An outer edge of a diaphragm 9 is clamped between an upper end of the diaphragm holder 8 and the upper cover 7. The cavity is partitioned into an upper chamber 91 and a lower chamber 92 by the diaphragm 9. The upper chamber 91 is enclosed by the diaphragm 9 and the upper cover 7. The lower chamber 92 is enclosed by the diaphragm 9 and the diaphragm holder 8. A plurality of vents 81 is disposed at the bottom of the diaphragm holder 8. The vent 81 is in communication with the outer space. The outer chamber 92 is in communication with the outer space through the vent 81. A spacer 10 is arranged between the diaphragm holder 8 and the lower cover 4. An air passage 101 in communication with the outer space is formed between the spacer 10 and the diaphragm holder 8. The air passage 101 is in communication with the vent 81.

An upper flange 11, which extends outwardly, is arranged on top of the inner tank 1. An outer side of the lower cover 4 is provided with a middle flange 41, which extends outwardly. A middle part of the upper cover 7 is provided with a lower flange 71, which extends outwardly. The upper flange 11, the middle flange 41, and the lower flange 71 are fastened via bolt connection for easy installation.

The inlet pipe upper part of the inlet pipe 5 passes through the upper cover 7. Specifically, the inlet pipe 5 comprises an upper pipe 51, a middle pipe 52, and a lower pipe 53. The upper pipe 51 is integrally formed with the upper cover 7, and the middle pipe 52 is integrally formed with the lower cover 4. The separator 511 is arranged within the inner hole of the upper pipe 51. The through hole 512 is arranged on a middle part of the separator 511. An upper part of the middle pipe is fitted into a lower part of the upper pipe 51. The radial communication hole 513 is arranged within the upper pipe 51. The radial communication hole 513 is located between the through hole 512 and a top end of the middle pipe 52. The upper chamber 91 and the inner hole of the upper pipe 51 is in communication via the radial communication hole 513. A top end of the lower pipe is fitted into the lower part of the middle pipe. A seal ring is arranged between the outer surface of the top end of the lower pipe and the inner surface of the middle pipe 52.

A clamping protrusion 531 is arranged on an outer surface of the upper part of the lower pipe 53. The clamping protrusion 531 has a polygonal cross section. A matching inner wall 521 is arranged within the middle pipe 52. The matching inner wall 521 is designed to have a polygonal cross section for matching with the clamping protrusion 531. The fitting of the clamping protrusion 531 and the matching inner wall 521 secures the middle pipe 52 and the lower pipe 53 in a circumferential direction. A clamping groove 522, 532 is arranged on both the lower part of the middle pipe and the upper part of the lower pipe. A U-shaped clip 54 is arranged on the clamping groove 522, 532 for securing the middle pipe 52 and the lower pipe 53 in a radial direction.

A bend section is arranged on a middle part of the lower pipe 53. The outlet port 5*a* on a bottom end of the lower pipe 53 faces a center of a bottom of the inner tank 1. The baffle 55 is attached to the bottom end of the lower pipe. The outlet port 5*a* is located beneath the baffle 55.

The electric heating pipe 2 is arranged on an outer bottom of the inner tank 1. The controller 3 controls the work of the electric heating pipe 2. A temperature sensing pipe 20 is arranged within the inner tank 1. An upper temperature sensor is arranged in an upper part of the temperature sensing pipe 20. A lower temperature sensor is arranged in a lower part of the temperature sensing pipe 20. When the lower temperature sensor detects the water temperature is lower than a first predetermined value, the controller 3 initiates the electric heating pipe 2 to start heating. When the upper temperature sensor detects that the water temperature is higher than a second predetermined value, the controller 3 halts the work of the electric heating pipe 2.

A metal water level detector 30 is arranged on the lower cover 4. When the water level in the inner tank 1 is lower than the metal water level detector 30, the controller 3 cuts off the power supply to the electric heating pipe 2.

A thermal insulation layer 1*a* is covered on the outer surface of the inner tank 1. A case 1*b* is further provided to accept the inner tank 1 and the thermal insulation layer 1*a*. The controller 3 is arranged on the case 1*b*. A display and button panel 1*c* is further disposed on the case 1*b*. The controller 3 is electrically connected to the display and button panel 1*c*. A temperature limiter 1*d* is arranged on the outer bottom of the inner tank 1.

When in use, the inner tank 1 is filled with water. The controller 3 switches on the power supply to the electric heating pipe 2 so that the electric heating pipe 2 can heat up the water. When the temperature of the water is higher than 85° C., water within the inner tank 1 begins to generate steam and expand. The generated steam and expanded water pass through the lower pipe 53, the middle pipe 52, and the radial communication hole 513, and at last enter the upper chamber 91. Because the diaphragm 9 is deformable, the generated steam and the expanded water can be absorbed by the upper chamber 91. When the temperature of the water reaches 100° C., the controller 3 cuts off the power supply to the electric heating pipe 2 to halt heating.

When users want to have the water within the inner tank, switch on the outlet pipe 6 and the boiled water can be output. When introducing water in the inner tank, the water outrushes from a path passing through a great diameter to a small diameter. In this situation, syphonage can occur when the water passes through the through hole 512, and therefore the water can be sucked into the inner tank 1, and the diaphragm will return back to its original position for the next heating.

The above are merely embodiments of the present disclosure and are not intended to limit the present disclosure. Any modifications, equivalent replacements, and improvements made within the spirit and principle of the present disclosure may be made by one of ordinary skill in the art and shall be comprised in the protection of the present disclosure.

What is claimed is:

1. A water boiler, comprising an inner tank;

a controller;

an electric heating pipe operable by the controller;

an upper cover; and a lower cover attached to a mouth of the inner tank, the lower cover comprising an inlet pipe and an outlet pipe;

wherein an outlet port at a lower part of the inlet pipe is in communication with a lower part of the inner tank;

an inlet port of a lower part of the outlet pipe is in communication with an upper part of the inner tank; the lower cover is arranged beneath the upper cover;

an upper part of the inlet pipe passes through the upper cover;

a cavity is formed between the lower cover and the upper cover; the cavity is partitioned into an upper chamber and a lower chamber by a diaphragm;

the lower chamber is in communication with an outer space;

a separator is formed within an inner hole of the upper part of the inlet pipe; a through hole is arranged on a center of the separator;

a radial communication hole is defined in the inlet pipe under the through hole;

the radial communication hole is in communication between the upper chamber and the inner hole of the inlet pipe; and the electric heating pipe is located at an outer bottom of the inner tank or is located within the inner tank.

2. The water boiler according to claim 1, wherein an outwardly extending upper flange is arranged on top of the inner tank; an outer side of the lower cover is provided with an outwardly extending middle flange; a middle part of the upper cover is provided with an outwardly extending lower flange; and the upper flange, the middle flange, and the lower flange are fastened via a bolt connection.

3. The water boiler according to claim 1, wherein a diaphragm holder is arranged between the lower cover and the upper cover; the cavity is located between the upper cover and the diaphragm holder; the diaphragm holder comprises a vent at a bottom of the diaphragm holder; the vent is in communication with the outer space; a periphery of the diaphragm is clamped between an upper side of the diaphragm holder and the upper cover; the diaphragm and the upper cover together form the upper chamber; the diaphragm and the diaphragm holder together form the lower chamber; the lower chamber is in communication with the outer space through the vent.

4. The water boiler according to claim 3, wherein a spacer is arranged between the diaphragm holder and the lower cover; an air passage in communication with the outer space is formed between the spacer and the diaphragm holder; the air passage is in communication with the vent; the air passage formed by the assembly of the spacer and the diaphragm holder allows the diaphragm to be deformable.

5. The water boiler according to claim 1, wherein a temperature sensing pipe is arranged within the inner tank; an upper temperature sensor is arranged in an upper part of the temperature sensing pipe; a lower temperature sensor is arranged in a lower part of the temperature sensing pipe;

when the lower temperature sensor detects that a water temperature is lower than a first predetermined value, the controller initiates the electric heating pipe to start heating; when the upper temperature sensor detects that the water temperature is higher than a second predetermined value, the controller halts the work of the electric heating pipe.

6. The water boiler according to claim 1, wherein, a metal water level detector is arranged on the lower cover; when the water level in the inner tank is lower than the metal water level detector, the controller cuts off the power supply to the electric heating pipe.

7. The water boiler according to claim 1, wherein a baffle is arranged on a bottom end of the inlet pipe; the outlet port at the lower part of the inlet pipe is beneath the baffle.

8. The water boiler according to claim 1, wherein the inlet pipe comprises an upper pipe, a middle pipe, and a lower pipe; the upper pipe is integrally formed with the upper cover, and the middle pipe is integrally formed with the lower cover; the separator is arranged within the inner hole of the upper pipe; the through hole is arranged on a middle part of the separator; an upper part of the middle pipe is fitted into a lower part of the upper pipe; the radial communication hole is arranged within the upper pipe; the radial communication hole is located between the through hole and a top end of the middle pipe; the upper chamber and the inner hole of the upper pipe is in communication via the radial communication hole; a top end of the lower pipe is fitted into the lower part of the middle pipe.

9. The water boiler according to claim 8, wherein a clamping protrusion is arranged on an outer surface of the upper part of the lower pipe; the clamping protrusion has a polygonal cross section; a matching inner wall is arranged within the middle pipe; the matching inner wall is designed to have a polygonal cross section for matching with the clamping protrusion; the fitting of the clamping protrusion and the matching inner wall secures the middle pipe and the lower pipe in circumferential direction;

a clamping groove is arranged on both the lower part of the middle pipe and the upper part of the lower pipe; a U-shaped clip is arranged on the clamping groove to secure the middle pipe and the lower pipe in a radial direction.

10. The water boiler according to claim 8, wherein a bend section is arranged on a middle part of the lower pipe; an outlet port on a bottom end of the lower pipe faces a center of a bottom of the inner tank; the baffle is attached to the bottom end of the lower pipe; the outlet port of the bottom end of the lower pipe is located beneath the baffle.

* * * * *